United States Patent [19]

Gilmore

[11] Patent Number: 5,011,318

[45] Date of Patent: Apr. 30, 1991

[54] PAPER BINDING FASTENER

[76] Inventor: Peggy M. Gilmore, 1773 Palmer Rd., Washington C.H., Ohio 43160

[21] Appl. No.: 329,963

[22] Filed: Mar. 29, 1989

[51] Int. Cl.[5] ..... B42F 13/08

[52] U.S. Cl. ..... 402/14; 402/15; 402/64; 402/68

[58] Field of Search ..... 402/14, 15, 16, 64, 402/68, 80 R

[56] References Cited

U.S. PATENT DOCUMENTS

| | | | |
|---|---|---|---|
| 687,437 | 11/1901 | Reynolds et al. | 402/14 |
| 894,478 | 7/1908 | Blaine, Jr. | 402/14 |
| 1,517,712 | 12/1924 | Davie | 402/64 |
| 1,788,303 | 1/1931 | Jennings, Sr. | 402/68 X |
| 2,153,399 | 4/1939 | Steinthal | 402/14 |
| 3,503,694 | 3/1970 | Whadcoat et al. | 402/68 |
| 4,289,331 | 9/1981 | Finger et al. | 281/47 |
| 4,534,671 | 8/1985 | Häfner | 402/80 R |
| 4,547,091 | 10/1985 | Josynla et al. | 402/12 |
| 4,587,151 | 5/1986 | Balland | 428/156 |
| 4,674,906 | 6/1987 | Abildgaard | 402/80 P |

FOREIGN PATENT DOCUMENTS

| | | | |
|---|---|---|---|
| 2206662 | 8/1973 | Fed. Rep. of Germany | 402/14 |

*Primary Examiner*—Paul A. Bell
*Attorney, Agent, or Firm*—Jerry T. Kearns

[57] ABSTRACT

A paper binding fastener for use with a conventional prong type fastener includes a rectangular strip of a deformable material which has elongated tab portions at opposite sides thereof. The rectangular strip has a pair of parallel fold lines which allow the rectangular strip member to be folded into a five sided rectangular channel shape. Each of the tab members have a pair of folded lines which are adapted to be folded laterally to form sidewall portions of the five sided rectangular channel. A pair of holes in the top and bottom edges of the rectangular strip member and an additional hole in each of the tab members are in axial alignment at each side of the folded channel member. This allows insertion of a conventional prong type paper fastener. In a modified form, the holes in the tab members are replaced by a plurality of spaced slits to allow a range of adjustment for different paper sizes. In a second embodiment, the paper fastener is formed from two L-shaped members which are secured together by a pair of deformable U-shaped clamps to form a three sided rectangular channel member. Two pairs of axially aligned holes allow insertion of a conventional prong paper fastener.

3 Claims, 3 Drawing Sheets

PAPER BINDING FASTENER

BACKGROUND OF THE INVENTION

1. Field of the Invention

The present invention relates to paper binding fasteners, and more particularly pertains to a new and improved paper binding fastener specifically adapted for use with the conventional pronged form of paper fastener sold under the trademark of ACCO. This conventional form of pronged paper fastener is adapted for use in a binder for securement of loose leaf sheets of paper. A pair of holes is punched through the paper along one edge, at spaced predetermined locations. The prongs of the first fastening member are inserted through the spaced apertures and through a second fastening member which overlies the top sheet of the paper in the stack. The prongs are then folded inwardly, parallel to the surface of the paper and are secured by a pair of sliding closure members. This conventional construction allows additional sheets to be added or removed in a convenient manner. However, these conventional fasteners and binders employing the same do not provide a suitable surface for affixing a spine label. Thus, when the binder is stored on a bookshelf, the title or label is not in view. Additionally, paper sheets secured by this conventional prong fastener are prone to tear out around the punched apertures. This is due to the stress concentrations created by the apertures and to the relatively sharp edges of the fastening prongs. In order to provide a spine labelling surface and to provide reinforcement around the punched sheet apertures, the present invention provides an improved paper binder fastening device.

2. Description of the Prior Art

Various types of paper binding fasteners are known in the prior art. A typical example of such a paper binding fastener is to be found in U.S. Pat. No. 4,289,331, which issued to A. Finger et al on Sept. 15, 1981. This patent discloses a binder having a rigid back spine and covers hinged thereto, with the spine provided with transverse openings for receiving projections of clips securable to the back of a plurality of periodicals. U.S. Pat. No. 4,534,671, which issued to R. Hafner on Aug. 13, 1985, discloses a holder with a stack of sheets, each provided with a hole through which a pin passes, the sheets being provided with a slot that extends from the hole to the edge of the sheet, and a cutout that is diametrically opposed to the slot. An annular part formed from a thin plate of stiff and optionally easily bent material is secured to the pin. U.S. Pat. No. 4,547,091, which issued to B. Josyula et al on Oct. 15, 1985, discloses a file fastener for a stack of paper sheets provided with a pair of protected covers, a pair of plates, and a pliable hollow tube that passes through holes in the sheets, the covers and the plates and around notched corners in the plate. A short rod secures both ends of the tube together to form a continuous locking band. U.S. Pat. No. 4,587,151, which issued to F. Balland on May 6, 1986, discloses a mobile binding consisting of two sheets of cardboard which extend over the whole length of the binding and which are stuck to each other, except in the end portions of the spine, and an opening provided in the inner sheet of cardboard, perpendicular to each of these end portions. The element are adapted for the securement of magazines. U.S. Pat. No. 4,674,906, which issued to W. Abildgaard on June 23, 1987, discloses a book binding strip formed from plastic which has longitudinally spaced studs each of which can be bent over at a ninety degree angle. A second strip has holes through which the studs fit and grooves which receive and secure the bent over studs. Paper punched to receive the studs is clamped between the two strips.

While the above mentioned devices are suited for their intended usage, none of these devices disclose a paper binding fastener adapted for use with a conventional prong type fastener which provides reinforcement against tear out and spine label attachment. Inasmuch as the art is relatively crowded with respect to these various types of paper binding fasteners, it can be appreciated that there is a continuing need for and interest in improvements to such paper binding fasteners, and in this respect, the present invention addresses this need and interest.

SUMMARY OF THE INVENTION

In view of the foregoing disadvantages inherent in the known types of paper binding fasteners now present in the prior art, the present invention provides an improved paper binding fastener. As such, the general purpose of the present invention, which will be described subsequently in greater detail, is to provide a new and improved paper binding fastener which has all the advantages of the prior art paper binding fasteners and none of the disadvantages.

To attain this, representative embodiments of the concepts of the present invention are illustrated in the drawings and make use of a paper binding fastener for use with a conventional prong type fastener including a rectangular strip of a deformable material having elongated tab portions at opposite sides thereof. The rectangular strip has a pair of parallel fold lines which allow the rectangular strip member to be folded into a five sided rectangular channel shape. Each of the tab members have a pair of fold lines which are adapted to be folded laterally to form sidewall portions of the five sided rectangular channel. A pair of holes in the top and bottom edges of the rectangular strip member and an additional hole in each of the tab members are in axial alignment at each side of the folded channel member. This allows insertion of a conventional prong type paper fastener. In a modified form, the holes in the tab members are replaced by a plurality of spaced slits to allow a range of adjustment for different paper sizes. In a second embodiment, the paper fastener is formed from two L-shaped members which are secured together by a pair of deformable U-shaped clamps to form a three sided rectangular channel member. Two pairs of axially aligned holes allow insertion of a conventional prong paper fastener. The paper binder fasteners of the present invention provide a more secure binding to the pages therein, preventing strain and loosening of the wire prong fasteners during use and thereby provide a resistance to tearing out of pages and also provide a labeling surface on the spine of a binder.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved paper binding fastener which has all the advantages of the prior art paper binding fasteners and none of the disadvantages.

It is another object of the present invention to provide a new and improved paper binding fastener which may be easily and efficiently manufactured and marketed.

It is a further object of the present invention to provide a new and improved paper binding fastener which is of a durable and reliable construction.

An even further object of the present invention is to provide a new and improved paper binding fastener which is susceptible of a low cost of manufacture with regard to both materials and labor, and which accordingly is then susceptible of low prices of sale to the consuming public, thereby making such paper binding fasteners economically available to the buying public.

Still yet another object of the present invention is to provide a new and improved paper binding fastener which provides in the apparatuses and methods of the prior art some of the advantages thereof, while simultaneously overcoming some of the disadvantages normally associated therewith.

Still another object of the present invention is to provide a new and improved paper binding fastener which provides a spine labelling surface.

Yet another object of the present invention is to provide a new and improved paper binding fastener which provides reinforcement to resist the tearing out of punched sheets utilized with conventional pronged fasteners.

Even still another object of the present invention is to provide a new and improved paper binding fastener adapted to be formed from a flat rectangular strip provided with a plurality of fold lines.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
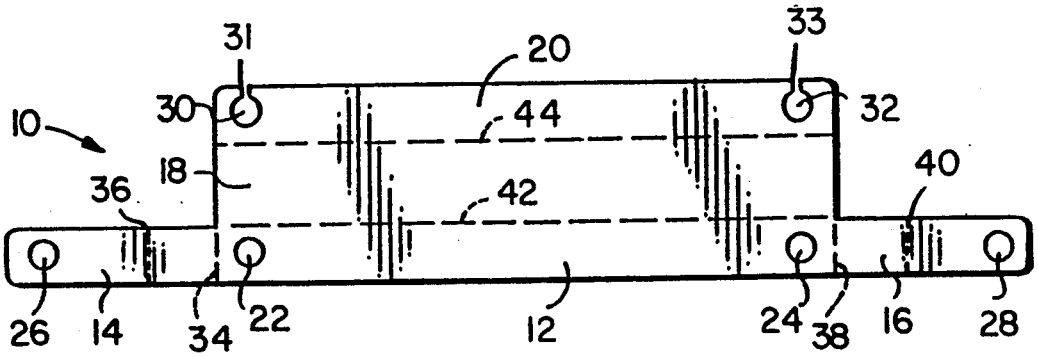
FIG. 1 is a plan view of the paper binding fastener according to the first embodiment of the present invention.

With reference now to the drawings, and in particular to FIG. 1 thereof, a new and improved paper binding fastener embodying the principles and concepts of the present invention and generally designated by the reference numeral 10 will be described.

More specifically, it will be noted that the first embodiment 10 of the invention includes a generally rectangular strip 12 which is formed from a deformable material such as that utilized to construct manilla file folders or a light gauge of plastic or sheet metal. The rectangular strip 12 is provided with a pair of spaced parallel fold lines 42 and 44. The rectangular strip is thus subdivided into a bottom portion 12, a middle portion 18 and top portion 20. A pair of elongated tabs 14 and 16 extend from opposite sides of the bottom of the strip 12. A pair of holes 26 and 28 are formed through outer end portions of the tabs 14 and 16. Additional holes 22, 24, 30 and 32 are formed through each corner portion of the rectangular strip 12. Slots 31 and 33 extend from the edge of the top portion 20 to the holes 30 and 32, to allow lateral insertion of the prongs of a conventional paper fastener.

Figure 2:
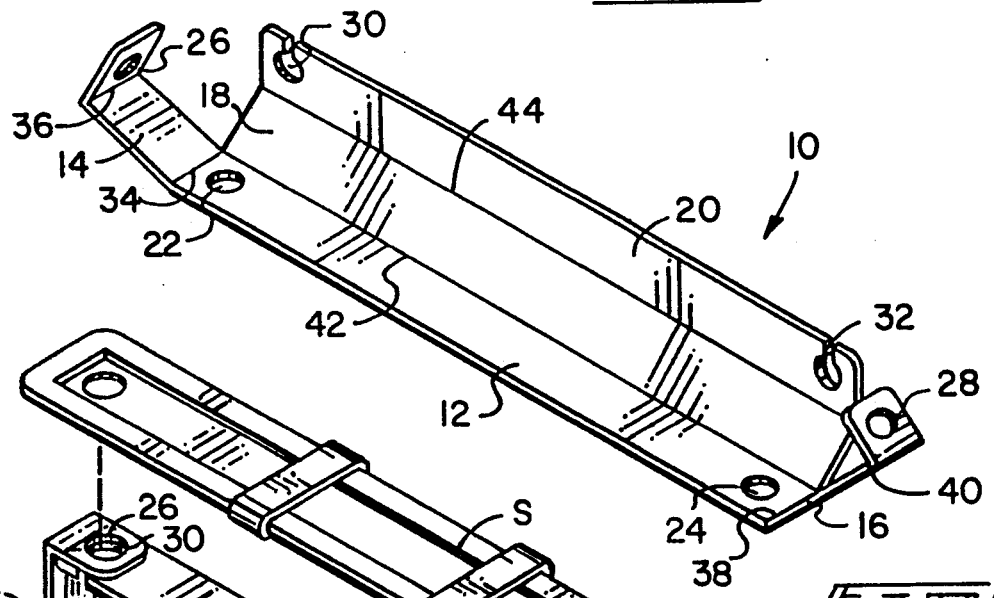
FIG. 2 is a perspective view of the paper binding fastener according to the first embodiment of the present invention, in a partially folded condition.
Figure 3:
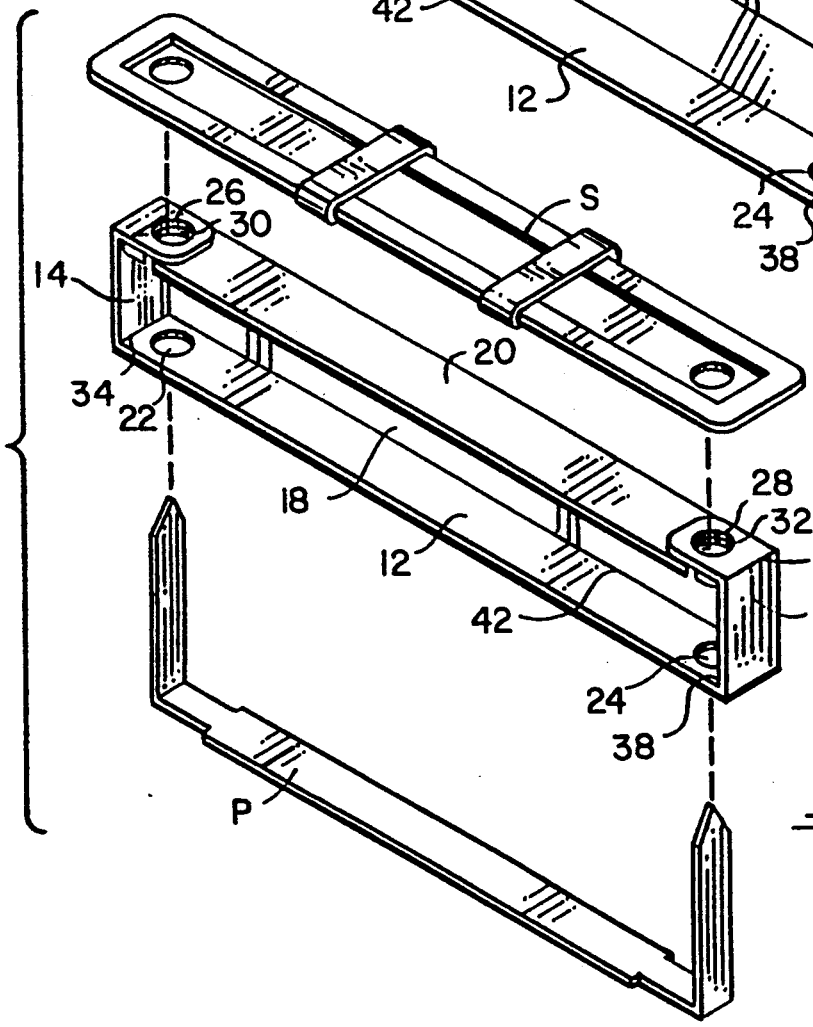
FIG. 3 is an exploded perspective view illustrating the paper binding fastener according to the first embodiment of the present invention in a folded operative position as employed with a conventional pronged paper fastener device.

FIG. 2 illustrates the paper fastener 10 in the process of being folded to an operative configuration. The rectangular strip 12 is folded upwardly along the fold line 42 to a configuration in which the bottom portion of the strip 12 and the middle portion of the strip 18 extend in perpendicular directions. The top portion 20 of the strip is then folded along the fold line 44 so that it extends parallel to the bottom portion 12 and perpendicular to the middle portion 18. In this configuration, the rectangular strip 12 has been folded to a three sided channel configuration. Each of the tabs 14 and 16 is then folded along a pair of spaced fold lines 34, 36, 38, 40 to form a five sided open box configuration as illustrated in FIG. 3. As shown, the fold lines 34, 36, 38 and 40 in the tabs 14 and 16 extend perpendicular to the fold lines 42 and 44 in the rectangular strip 12.

As shown in FIG. 3, when the paper fastening device 10 is completely folded to the operative position, the holes 22, 30 and 26 extend in axial alignment at one end and the holes 24, 32 and 28 are in axial alignment at the other end. This allows the prongs of a conventional paper fastener P to be inserted through the aligned holes. Upon insertion through the aligned holes and also through a stack of apertured papers received between the bottom wall 12 and top wall 20, the prongs are then placed into engagement with the conventional slide prong fastener S. This method of assembly is preferred for use with rigid sheet materials. For use with more flexible paper sheets, the fastener may be assembled by laying the bottom portion 12 over the prong fastener P, adding the sheets to be bound, and then folding over tab ends placing holes 26 and 28 over their respective prongs and finally wrapping the spine just before replacing the top binder cover and conventional slide prong fastener S. This method may be employed for changing of pages, without necessarily dismantling the entire book. The paper fastening device 10 of the first embodiment of the present invention may be provided in a variety of different lengths for use with different sizes of paper. For example, for use along the length of a conventional eight and one half by eleven inch sheet of paper, the length of the bottom wall 12 between the fold lines 34 and 38 will be eleven inches. The distance between fold lines 34 and 38 will be exactly the same length as the top wall 20, which, for an eleven inch sheet of paper, would be eleven inches. It is extremely important that the paper binder fastener fits snugly to produce its benefits. Additionally, it is contemplated that the width of the middle portion 18 may be varied for use with different stack thicknesses of paper to be secured. Similarly, the length of the tabs 14 and 16 will be accordingly adjusted dependent upon the stack thickness to be employed.

As may now be readily understood, the back surface of the middle portion 18 provides a surface to which a spine label may be affixed. Additionally, the fastener 10 provides a reinforcement box which prevents the tearing out of pages secured by the prong fastener P.

Figure 4:
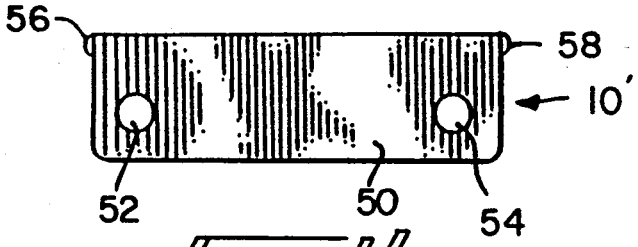
FIG. 4 is a top view of a paper binding fastener according to a second embodiment of the present invention.

With reference now to FIG. 4, a paper binding fastener 10' according to the second embodiment of the present invention will now be described. FIG. 4 provides a top view of the paper fastener 10'. The top wall 50 is provided with pair of spaced apertures 54 and 57. Additionally, a pair of U-shaped deformable clamp members 56 and 58 are formed at opposite sides on a downwardly extending leg portion which is perpendicularly secured to the top wall 50.

Figure 5:
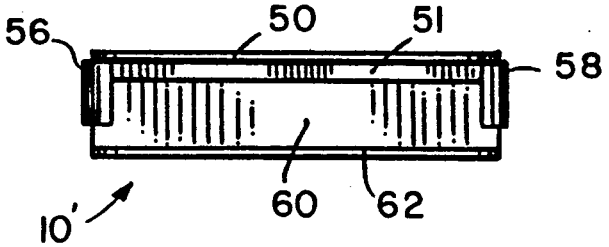
FIG. 5 is a front view of a paper binding fastener according to the second embodiment of the present invention.

FIG. 5 provides a front view of the paper binding fastener 10' according to the second embodiment of the present invention. The top plate member 50 is integrally formed with a downwardly depending transverse leg portion 51 which forms a first L-shaped member. A pair of deformable U-shaped clamp members 56 and 58, secured at opposite sides of the leg portion 51, serve to secure the leg portion 60 of a second L-shaped member. Thus, the leg members 51 and 60 extend in parallel overlying relation. The leg member 60 is transversely secured to a bottom plate 62 which extends in spaced parallel relation with the top plate 50.

Figure 6:
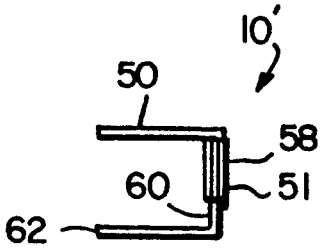
FIG. 6 is a side view of the paper binding fastener according to the second embodiment of the present invention.

FIG. 6 provides a side view of the paper binding fastener 10'. As may now be readily understood, the U-shaped clamp members 56 and 58 are deformed into frictional engagement with the leg member 60, thus securing the leg members 51 and 60 in overlying parallel relation. It is contemplated that the first upper L-shaped member 50, 51 and the second lower L-shaped member 60, 62 will each be formed from a light gauge sheet metal material. This allows the U-shaped clamp member 56 and 58 to be easily deformed into clamping engagement.

Figure 7:
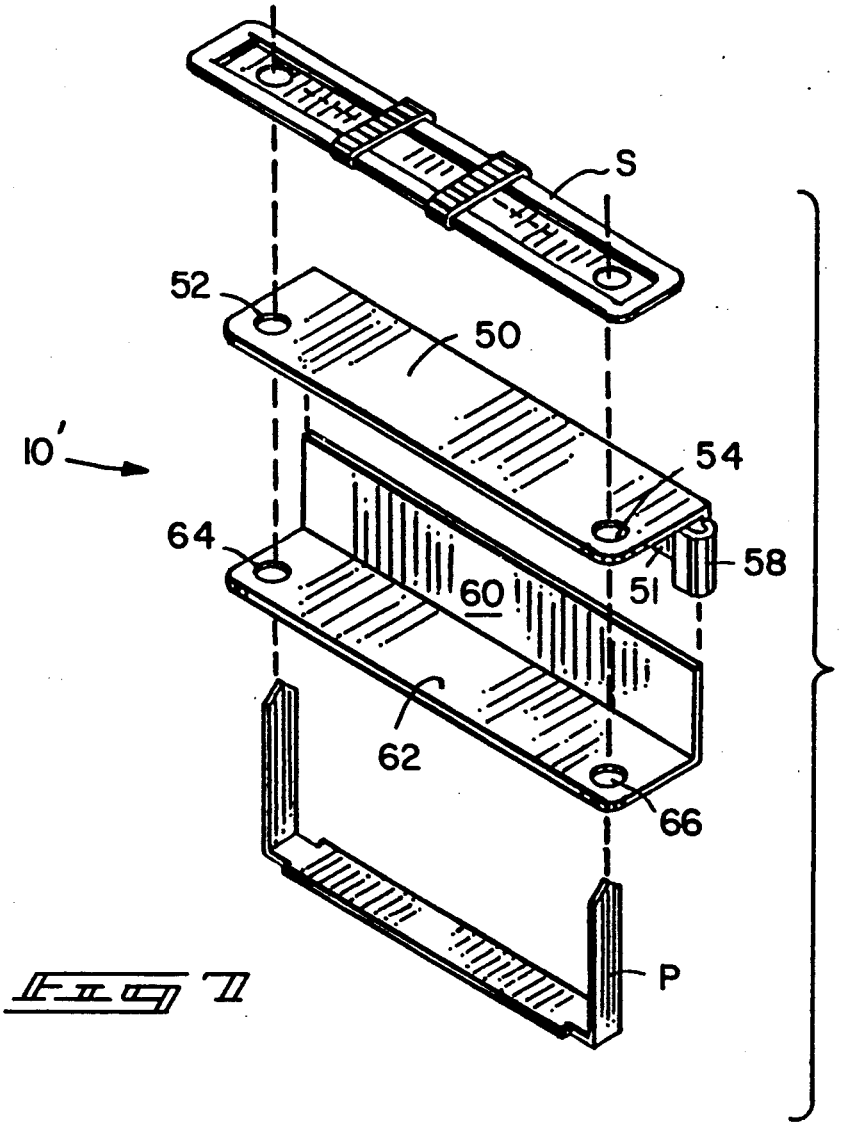
FIG. 7 is an exploded perspective view illustrating the manner of use of the paper binding fastener of the second embodiment of the present invention with a conventional pronged paper fastening device.

FIG. 7 provides an exploded perspective view illustrating the manner of usage of the paper binding fastener 10'. As shown, a pair of spaced holes 52 and 54 form through the top plate 50 are in axial alignment with a second pair of holes 64 and 66 formed through the bottom plate 62. A stack of punched paper sheets will be inserted between the top plate 50 and the bottom plate 62, with the punched apertures in the sheets in registry with the holes 52, 64 and 54 and 56. The U-shaped clamp members 56 and 58 will then be frictionally engaged with the leg member 60. The engagement of the clamp members 56 and 58 along the extent of the member 60 may be adjusted to accommodate various sheets stack thicknesses. The conventional prong fastener P will then be inserted through the registered apertures 64, 66 in the bottom plate 62, through the punched apertures in the sheet stack, and through the apertures 52, 54 in the top plate 50. The prong fasteners P will then be inserted through the apertures in the slide fastener S and bent inwardly and secured by the conventional slide loops on the fastener S. The back surface of the leg member 51 provides a surface to which a spine label may be readily affixed. The plate members 50 and 62 provide reinforcement to resist tear out of the punch apertures in the sheet stack and the deformable clamp members 56 and 58 allow adjustment for use with sheet stacks of varying thicknesses.

Figure 8:
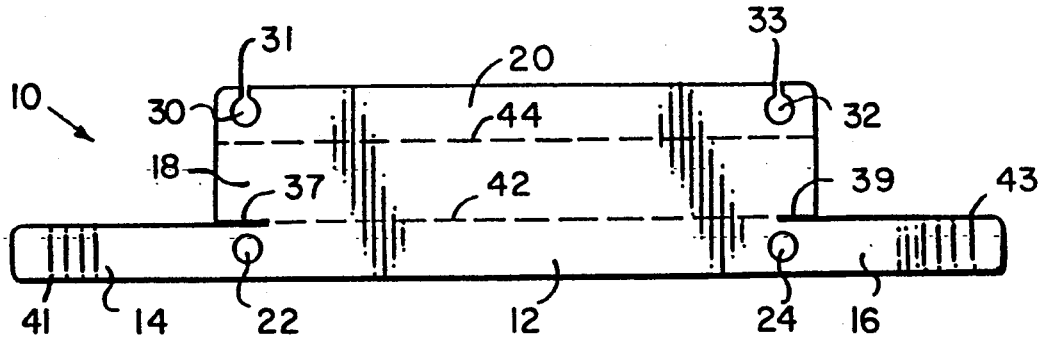
FIG. 8 is a plan view of the paper binding fastener according to a third embodiment of the invention.
Figure 9:
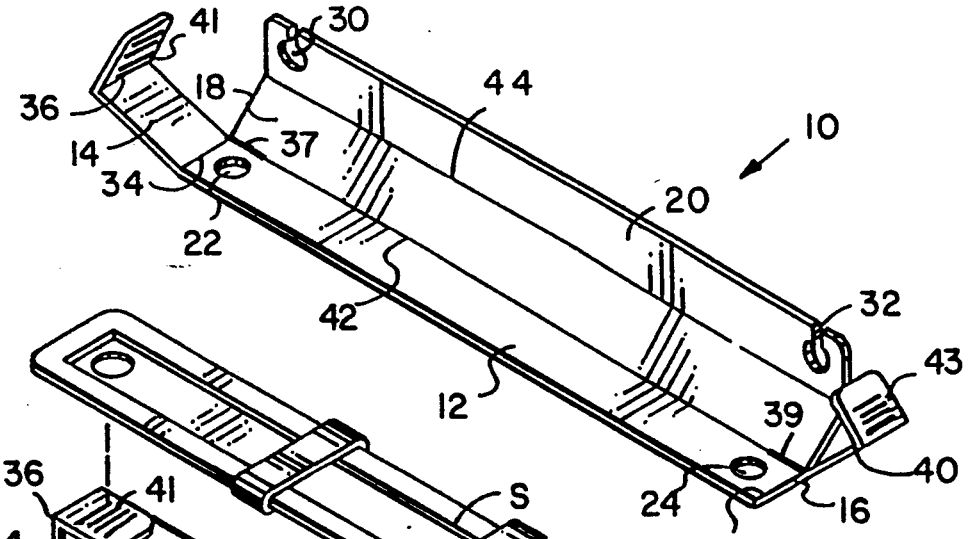
FIG. 9 is a perspective view of the paper binding fastener of FIG. 8, in a partially folded condition.
Figure 10:
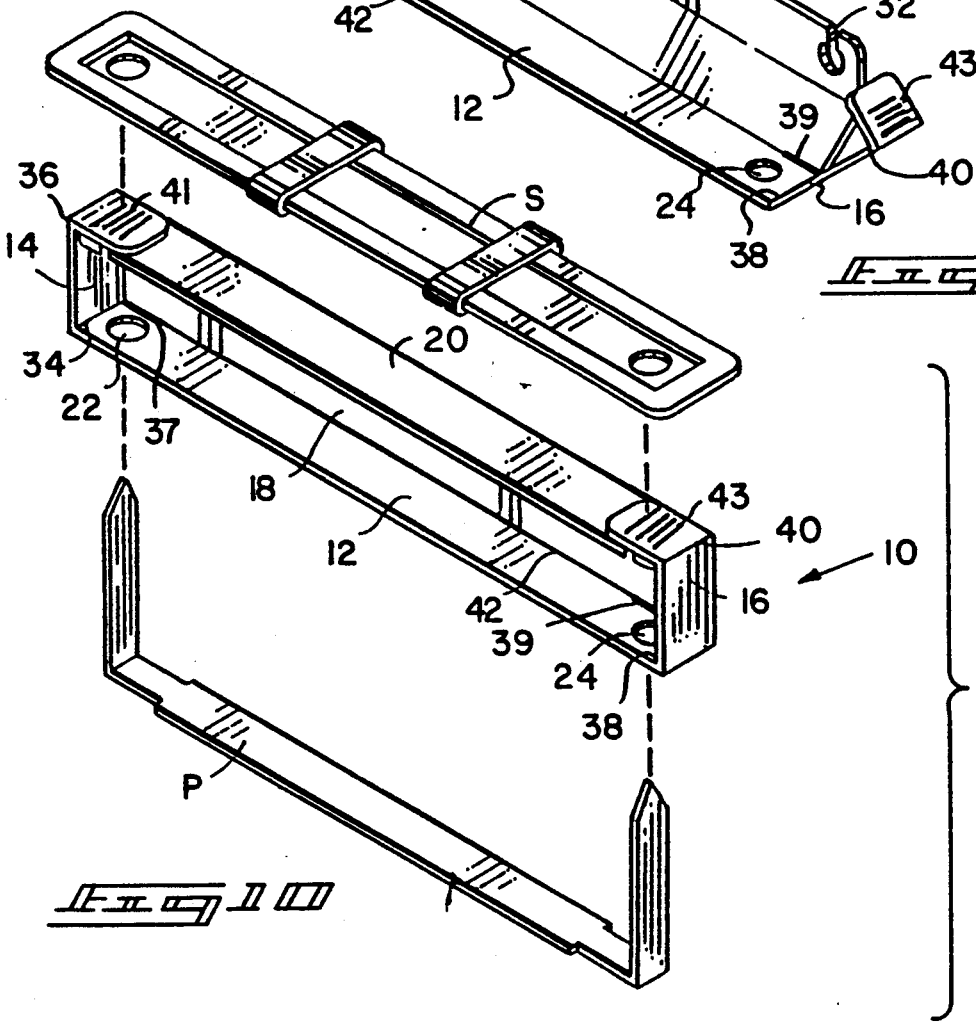
FIG. 10 is an exploded perspective view of the paper binding fastener of FIG. 8, as employed with a conventional pronged paper fastening device.

FIGS. 8–10 illustrate a third embodiment 10", generally similar to the first embodiment 10, described above with reference to FIGS. 1–3. A plurality of spaced slots 41 and 43 replace the holes 26 and 28 of the first embodiment 10, to allow adjustment for use with different lengths of paper. Slits 37 and 39 separate a portion of the tabs 14 and 16 from the portion 12, allowing for a further range of adjustment. The positions of the fold lines 34, 36, 38 and 40 are not predefined, but are user selected depending upon the size of paper utilized. As shown in FIG. 10, the prongs of the fastener P are received through one of each of the spaced row of slots 41 and 43, depending on the paper size utilized. It should be understood that suitable indicia may be provided on the tabs 14 and 16 which identify the correct positions of the fold lines 34, 36, 38 and 40, for a variety of standard paper sizes.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the U.S. is as follows;

1. A paper binder fastener for use with a conventional pronged paper fastener, comprising:

a three sided rectangular channel member having parallel top and bottom sides connected by a transversely extending side wall;

said three sided rectangular channel member formed by two connected L-shaped members;

one of said L-shaped members having a pair of deformable U-shaped clamp members at opposite side edges in frictional clamping engagement with the other L-shaped member;

and at least two pairs of holes formed in axial alignment at opposite ends of said top and bottom sides.

2. A paper binder fastener for use with a conventional pronged paper fastener, comprising:

a generally rectangular strip formed from a deformable material;

a pair of spaced parallel strip fold lines extending along a length of said rectangular strip;

a pair of elongated tabs extending from opposite sides of said rectangular strip, parallel to said strip fold lines;

a pair of spaced parallel tabs fold lines extending across each of said tabs, said tab fold lines extending perpendicular to said strip fold lines;

a hold formed through an outer end of each of said tabs;

a hole formed through each corner portion of said rectangular strip;

and a slit extending from an outer edge of said rectangular strip to two of said holes formed in said corner portions of said rectangular strip, whereby said rectangular strip may be folded along said strip fold lines and said tabs may be folded along said tab fold lines to form an open rectangular box configuration with three holes in axial alignment at each of two opposite sides.

3. A paper binder fastener for use with a conventional pronged paper fastener, comprising:

a generally rectangular strip formed from a deformable material;

a pair of spaced parallel strip fold lines extending along a length of said rectangular strip;

a pair of elongated tabs extending from opposite sides of said rectangular strip, parallel to said strip fold lines;

a pair of spaced parallel tabs fold lines extending across each of said tabs, said tab fold lines extending perpendicular to said strip fold lines;

a plurality of spaced slots formed through an outer end of each of said tabs;

a hold formed through each corner portion of said rectangular strip;

and a slit extending from an outer edge of said rectangular strip to two of said holes formed in said corner portions of said rectangular strip, whereby said rectangular strip may be folded along said strip fold lines and said tabs may be folded along said tab fold lines to form an open rectangular box configuration with two holes and one slot in axial alignment at each of two opposite sides.

* * * * *